United States Patent [19]

White

[11] 4,283,000

[45] Aug. 11, 1981

[54] SAMPLE HOLDER/DISPENSER

[75] Inventor: William L. White, Indian Head Park, Ill.

[73] Assignee: Patrick H. Joyce, Chicago, Ill. ; a part interest

[21] Appl. No.: 118,649

[22] Filed: Feb. 4, 1980

[51] Int. Cl.[3] ..... B65D 1/22; B65D 5/42

[52] U.S. Cl. ..... 229/17 B

[58] Field of Search ..... 229/17 B

[56] References Cited

U.S. PATENT DOCUMENTS

| | | | |
|---|---|---|---|
| 2,568,725 | 9/1951 | Fey | 229/17 B |
| 3,207,380 | 9/1965 | Hennessey | 229/17 B X |
| 3,301,388 | 1/1967 | Rockwell | 229/17 B X |
| 3,584,768 | 6/1971 | Ascough et al. | 229/17 B X |
| 3,593,908 | 7/1971 | Desmond | 229/17 B |
| 3,944,128 | 3/1976 | Hogan | 229/17 B |
| 4,039,118 | 8/1977 | Kawaoka | 229/17 B |
| 4,138,051 | 2/1979 | Zicko | 229/17 B |
| 4,186,866 | 2/1980 | Zicko | 229/17 B |

FOREIGN PATENT DOCUMENTS

| | | | |
|---|---|---|---|
| 1161645 | 3/1958 | France | 229/17 B |

*Primary Examiner*—Davis T. Moorhead

*Attorney, Agent, or Firm*—Wegner, Stellman, McCord, Wood & Dalton

[57] ABSTRACT

A dispenser arranged to be carried flat and manually assembled in an erected arrangement for dispensing small articles, such as medical samples. The dispenser includes a closure for selectively closing an opening at the bottom of the tubular sidewall thereof. The closure includes one or more flanges which cooperate with the closure in defining an upwardly opening access space when the closure is swung to an open position away from the opening. At least one of the flanges may be provided with a stop for limiting the outward swinging of the closure from the opening. A ramp guide is provided within the dispenser within the closure for guiding the articles outwardly through the opening into the access space for facilitating the dispensing of the articles. The dispenser container may be formed as a one-piece folded sheet element, permitting the same to be provided in a collapsed form for subsequent erection to define the dispenser configuration.

10 Claims, 8 Drawing Figures

SAMPLE HOLDER/DISPENSER

BACKGROUND OF THE INVENTION

1. Field of the Invention

This invention relates to dispensers for dispensing small articles.

2. Description of the Background Art

There has been a long-felt need for a simple, low cost dispenser which may be readily assembled at the dispensing location for dispensing small articles, such as samples and trial size units of different products.

Illustratively, in the medical field, pharmaceutical sales representatives conventionally visit doctors' offices to inform the doctors of their line of pharmaceuticals. There has been a need for such a dispenser for dispensing samples of such pharmaceuticals as are left by the sale representatives with the doctors for patient use.

In retail establishments, there has been a need for such a dispenser in storing and dispensing of samples and trial size units of products.

SUMMARY OF THE INVENTION

The present invention comprehends an improved low cost dispenser adapted to be readily assembled and filled with bulk samples or the like at that time for subsequent distribution. More specifically, the invention comprehends such a dispenser which is arranged to be carried flat and manually assembled into an erected dispenser arrangement.

The dispenser may be formed of flat sheet material which may have fold lines permitting the dispenser to be collapsed into a flat arrangement and opened into a vertically extending tubular container arrangement. A bottom wall is hingedly connected to a lower end of the sidewalls and means are provided on the bottom wall and sidewall for locking the bottom wall across the lower open end of the sidewall to define an article-holding dispenser.

An opening may be provided in the sidewall at the lower end thereof to pass the small articles contained in the dispenser outwardly therethrough for dispensing the same.

The opening may be selectively closed by a closure which, in the illustrated embodiment, is hingedly connected to the bottom wall so as to swing out from the plane of the bottom wall at the bottom of the discharge opening.

The closure in the illustrated embodiment is provided with side flanges which extend inwardly through the opening and cooperate with the closure in defining an upwardly opening access space when the closure is swung outwardly to an open position. In this position, articles from within the sidewall portion of the dispenser pass outwardly through the opening and are accessible through the outwardly opening access space for dispensing.

One or both of the flanges may be provided with a stop shoulder engaging the edge of the sidewall defining a portion of the discharged opening so as to limit the outward swinging of the closure from the closed position to the desired access position.

The invention further comprehends the provision within the dispenser of a guide means for guiding the articles automatically outwardly into the access space when the closure is swung to the open position and to cause the articles within the dispenser to replace those withdrawn from the access space as the articles are dispensed.

More specifically, the guide means comprises a ramp structure on the bottom wall which is inclined outwardly toward the discharge opening so as to urge the articles within the dispenser outwardly through the discharge opening into the access space.

In the illustrated embodiment, the ramp structure comprises a separate sheet member which is folded into the ramp configuration and fitted within the lower portion of the dispenser.

The ramp is arranged to have the lower end thereof terminate substantially at the discharge opening and at the level of the bottom wall so as to guide the articles into the access space throughout the entire height of the discharge opening.

The dispenser may be provided with a cover portion for closing the top of the dispenser after it is filled with the desired articles to be dispensed.

The dispenser is extremely simple and economical of construction while yet providing an improved facilitated dispensing of small articles.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 2:
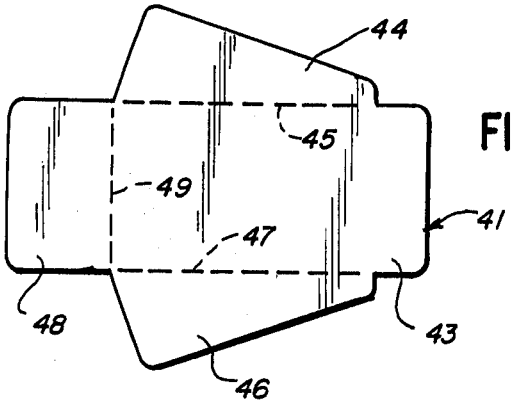
FIG. 2 is a plan view of a blank adapted to be formed into a ramp portion of the dispenser.

In the illustrative embodiment of the invention as disclosed in the drawing, a dispenser generally designated 10 is provided for dispensing small articles 11, such as pharmaceutical samples, as by a doctor for use by the doctor's patients. The dispenser is arranged to be carried flat and manually assembled in an erected arrangement as in the doctor's office.

Figure 1:
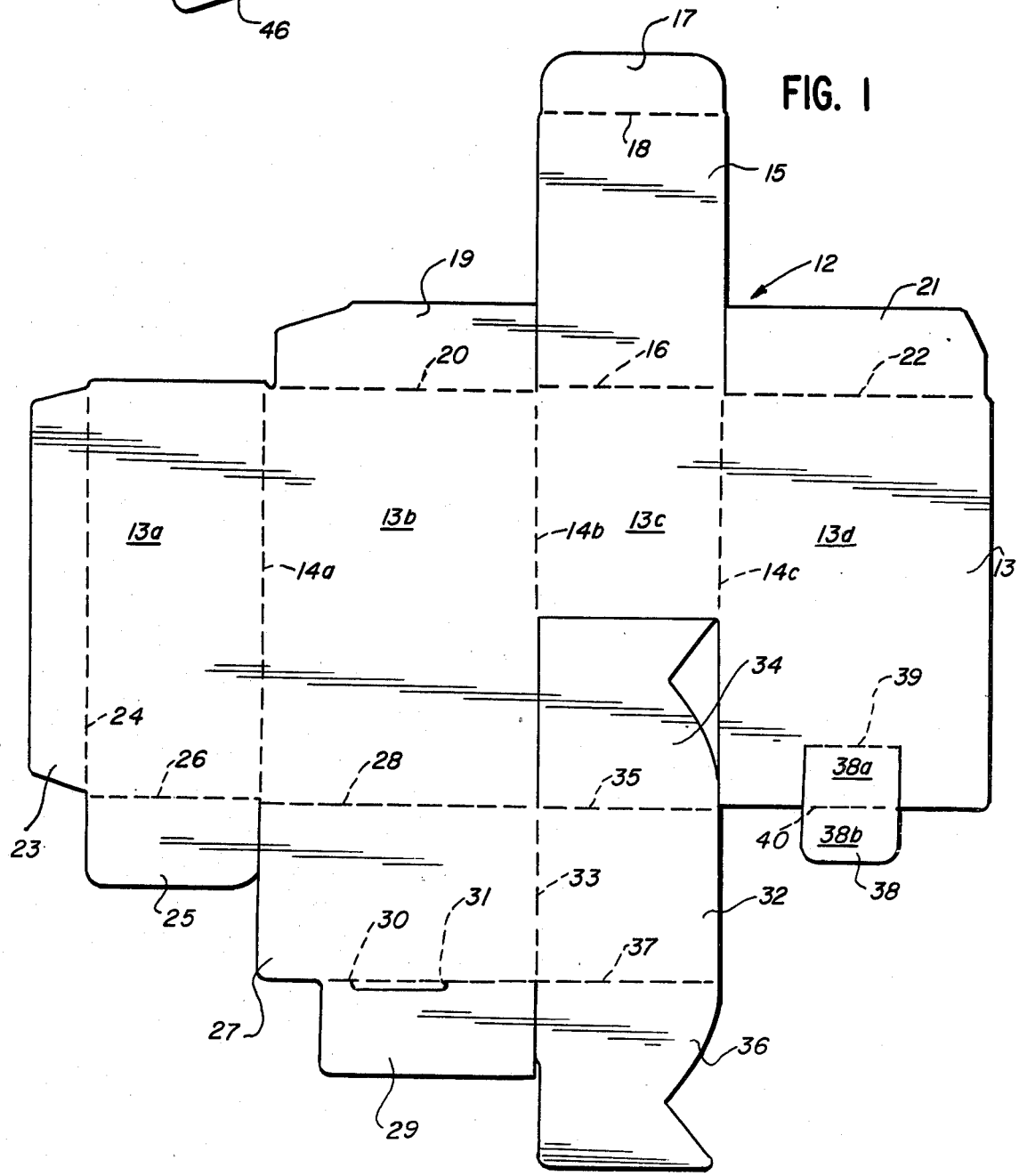
FIG. 1 is a plan view of a blank adapted to be formed into a dispenser embodying the invention.

As shown in FIG. 1, the dispenser may be formed from a die-cut blank generally designated 12. The blank may include a sidewall portion 13 divided into four generally rectangular portions 13*a*, 13*b*, 13*c* and 13*d* by fold lines 14*a*, 14*b*, and 14*c*. A cover portion 15 is connected to sidewall portion 13*c* by a fold line 16 and is provided with a flap portion 17 connected thereto by a fold line 18. Flap 19 is connected to the sidewall portion 13*b* by a fold line 20 and flap 21 is connected to the sidewall portion 13*d* by a fold line 22.

A flap 23 is connected to the sidewall portion 13*a* by a fold line 24 and a flap 25 is connected to the sidewall portion 13*a* by a fold line 26.

A bottom wall 27 is connected to the sidewall portion 13*b* by a fold line 28 and a flap 29 is connected to the bottom wall 27 by a fold line 30. An elongated opening 31 is provided in the flap 29 adjacent the fold line 30 as shown in FIG. 1.

A closure 32 comprising a wall element is connected to the bottom wall 27 by a fold line 33. A first flange 34 is connected to the closure 32 by a fold line 35 and a second flange 36 is connected to the closure 32 by a fold line 37.

A locking tab 38 is connected to the sidewall panel 13*a* by a fold line 39 and is provided with a fold line 40 for dividing the locking element into portions 38*a* and 38*b*.

Referring now to FIG. 2, a blank 41 for use in forming a guide 42 is shown to comprise a flat sheet having a ramp portion 43. A first angled sidewall 44 is connected to the ramp portion 43 by a fold line 45 and a second angled sidewall portion 46 is connected to the ramp portion 43 by a fold line 47. An end wall portion 48 is connected to the ramp portion 43 by a fold line 49.

The dispenser 10 thusly comprises a container portion generally designated 50 and a guide portion generally designated 42. The container portion may be partially assembled by adhesively securing flap 23 to the sidewall portion 13*d* as with the sidewall portion 13*d* folded back on fold line 14*c* and sidewall portion 13*a* folded back on fold line 14*a* so as to permit the sidewall portions 13*a* and 13*d* to lie flat under the sidewall portions 13*b* and 13*c* in the partially assembled condition.

Thus, the partially assembled container portion 50 and the guide portion 42 may be carried as by a pharmaceutical sales representative in flat form to a doctor's office such as in the sales representative's briefcase. At the doctor's office, the dispenser may be readily manually assembled, i.e. without the use of tools, permitting the sales representative to fill the dispenser at that time with the desired small articles, such as pharmaceutical samples, for subsequent dispensing by the doctor in the doctor's office. The erection and assembly of the dispenser is extremely simple, as illustrated in FIGS. 3–8.

Figure 3:
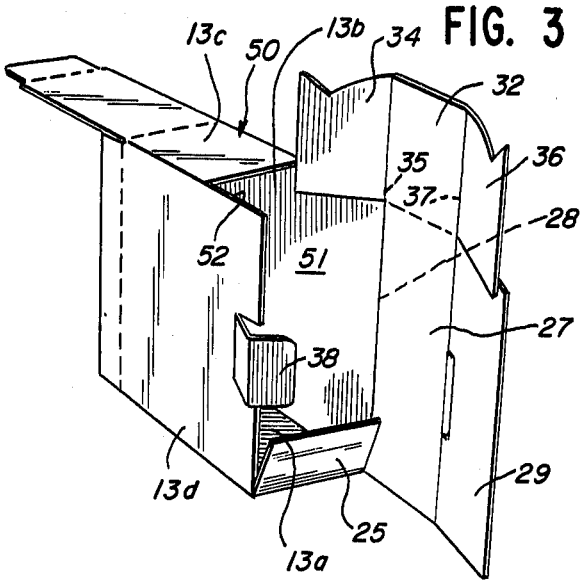
FIG. 3 is a perspective view illustrating a first step in the erection of the dispenser from a collapsed flat configuration thereof.

More specifically, as shown in FIG. 3, a first step in the erection of the dispenser container portion 50 comprises the expansion of the flat folded structure into a receptacle configuration wherein the sidewall portions are arranged to define a generally rectangular cross-sectional space 51. Flap 25 may be folded upwardly to extend across a portion of the lower end of space 51 and permit bottom wall 27 to be folded inwardly on fold line 28.

Prior to bringing the bottom wall 27 to the end of the container portion 50, flanges 34 and 36 are folded about fold lines 35 and 37, respectively, to extend perpendicularly to the closure and permit the reception through the opening 52 at the lower end of sidewall portion 13*c* resulting from the cutting of the flange 34 therefrom.

Figure 5:
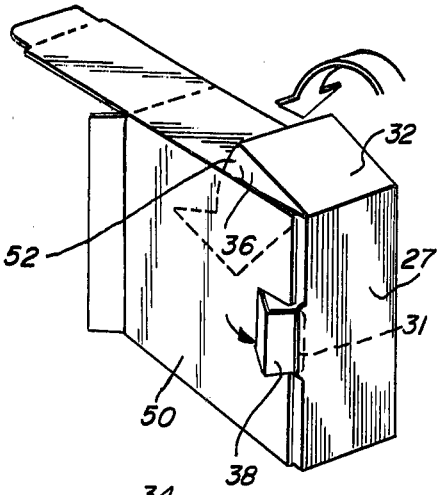
FIG. 5 is a perspective view illustrating a third step in the erection process.
Figure 4:
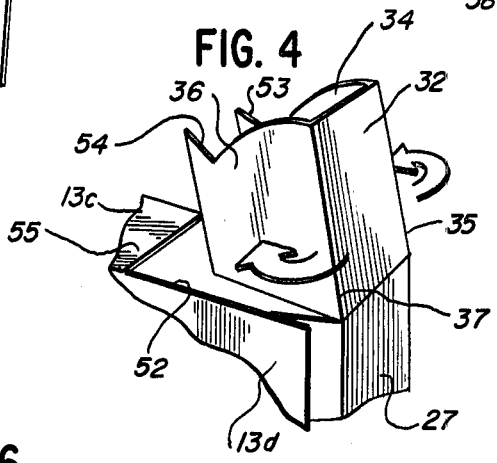
FIG. 4 is a fragmentary perspective view illustrating a second step in the erection of the dispenser.

As shown in FIG. 4, flange 34 defines a stop shoulder 53 and flange 36 defines a stop shoulder 54 extending at suitable angles so as to have linear engagement with the portion 55 of the sidewall portion 13*c* defining the upper edge of the opening 52 after the flanges are inserted through the opening 52, as illustrated in FIGS. 4 and 5.

As further shown in FIG. 5, after the flanges 36 and 34 are inserted through the opening 52, bottom wall 27 is swung fully to the closing position across the lower end of the container 50 and tab 38 is inserted through the opening 31 to lock the bottom wall across the lower end of the container.

Figure 6:
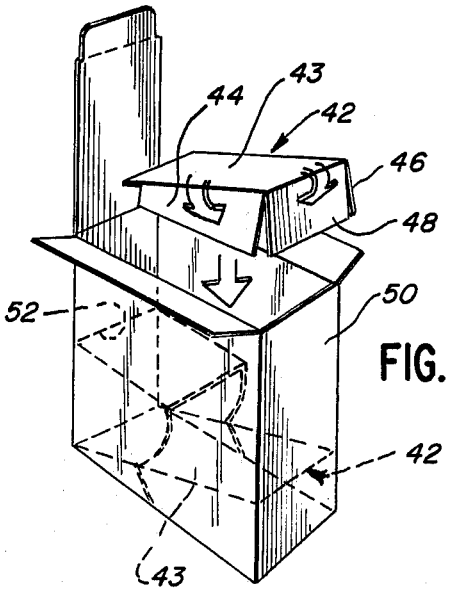
FIG. 6 is a perspective view illustrating the placement of the ramp guide means into the erected container portion of the dispenser.
Figure 7:
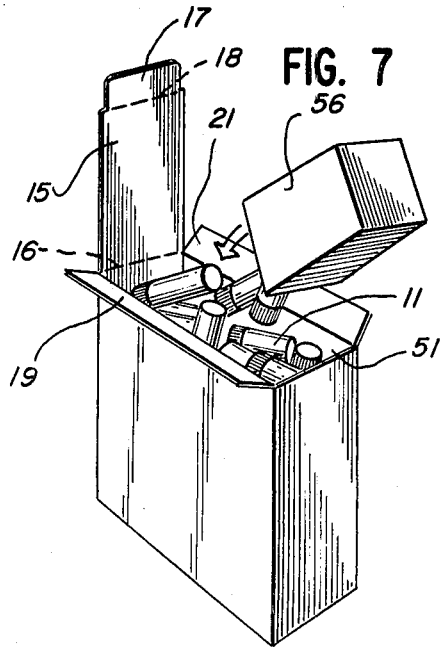
FIG. 7 is a perspective view illustrating the step of filling the dispenser with small articles to be dispensed.

As shown in FIG. 6, the guide 42 is formed from the blank 41 by holding down the sidewall portions 44 and 46 and end wall portion 48 and inserting the resultant folded ramp structure 42 downwardly through the upper end of the container 50 until the ramp structure rests on the bottom wall 27, as illustrated in dotted lines in FIG. 6. As shown therein, the lower end of the ramp portion 43 terminates at the bottom of the container and at the bottom of opening 52, thereby permitting articles 11 to be dispensed from the dispenser 10 to outwardly through the entire height of the discharge opening 52 while yet the ramp is inclined above the bottom wall 27 to a substantial height at the rear end thereof, as determined by the height of wall portion 49. Resultingly, a positive urging of the articles from the storage portion of container 50 outwardly through the discharge opening 52 is automatically effected in the use of the dispenser.

After the ramp guide 42 is installed, as discussed above, the articles 11 to be dispensed may be introduced into the container space 51 through the upper open end of the container as from a supply box 55 thereof.

Top wall 15 may then be folded down about hinge line 16 with flap 17 folded downwardly about hinge line 18 so as to effectively retain the top wall 15 as a cover for the dispenser. Prior to the swinging of the top wall to the position of FIG. 8, the top flaps 19 and 21 may be folded inwardly to overlie space 51 and underlie the cover 15.

Figure 8:
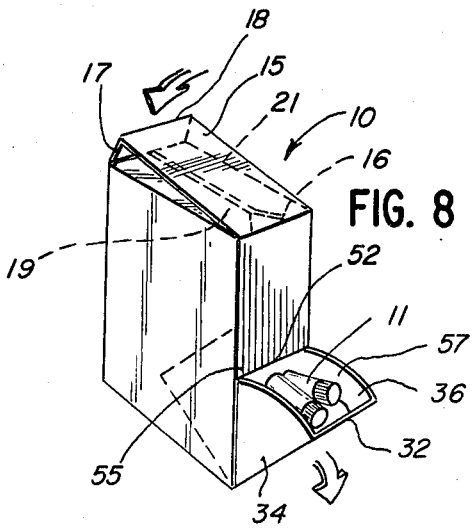
FIG. 8 is a perspective view illustrating a final step in the assembly and further illustrating the arrangement of the dispenser with the closure disposed in an access position for providing access to the articles delivered through a discharge opening of the dispenser.

As shown in FIG. 8, closure 32 is swung outwardly from opening 52 to the maximum position permitted by the engagement of stop shoulders 53 and 54 with the wall portion 55 thereby defining, with flanges 34 and 36, an upwardly opening access space 57 to which the articles 11 are guided by the ramp guide 42 for facilitated dispensing by the doctor to the patients. As the articles are removed from the access space by the doctor, ramp guide 42 guides replacement articles from within the container 50 into the access base as an automatic gravitational guided flow thereof.

In the illustrated embodiment, the blanks 12 and 41 are formed of corrugated sheet material, such as cardboard, providing substantial strength while yet permitting the formation of the dispenser at low cost.

As discussed above, the arrangement of the dispenser permitting it to be carried in flat folded form while yet readily erected and assembled when desired provides a highly desirable dispenser construction such as for use in dispensing pharmaceutical samples by doctors, as discussed above.

While the dispenser has been illustratively disclosed as for use in dispensing pharmaceutical samples, as will be obvious to those skilled in the art, the dispenser is advantageously adapted for use in storing and dispensing a wide range of small articles, including samples and trial size articles, in retailing operations.

The foregoing disclosure of specific embodiments is illustrative of the broad inventive concepts comprehended by the invention.

I claim:

1. A dispenser arranged to be carried flat and manually assembled in an erected arrangement for dispensing small articles, said dispenser comprising:

a tubular sidewall having fold lines permitting the sidewall to be collapsed into a flat arrangement and opened into a vertically extending tubular expanded arrangement, a bottom wall hingedly connected to a lower end of said sidewall, means on said bottom wall and sidewall for locking the bottom wall across said lower end of the sidewall with the sidewall disposed in the expanded arrangement thereby to retain the sidewall in the expanded arrangement and define with said sidewall a closed-bottom container for containing a plurality of small articles to be dispensed, said sidewall further defining an opening at said lower end, a closure having a lower end hingedly connected to said bottom wall for selectively closing said opening, and flanges on said closure extending inwardly through said opening and having a stop shoulder on an inner distal portion thereof disposed to engage the sidewall at an edge of said opening to limit the movement of the closure away from said opening to a preselected open position, said closure and flanges cooperatively defining an upwardly open access space when said closure is in said open position;

a top wall hingedly connected to said sidewall above said opening and having a flap portion connected to the distal end thereof at a fold line for retaining the top wall across the top of the tubular sidewall to act as a selectively positionable cover for the dispenser permitting ready refilling of the dispenser as desired; and guide means carried on said bottom wall for guiding the small articles from the container outwardly through the opening into said access space.

2. The dispenser of claim 1 wherein said guide means comprises a wall member having fold lines permitting the wall member to be disposed in a flat arrangement and folded to a three-dimensional configuration suitable to guide said articles outwardly through said opening.

3. The dispenser of claim 1 wherein said guide means comprises a wall member having fold lines permitting the wall member to be disposed in a flat arrangement and folded to a three-dimensional inclined ramp configuration suitable to guide said articles outwardly through said opening.

4. The dispenser of claim 1 wherein said dispenser is formed of corrugated sheet material.

5. The dispenser of claim 1 wherein said opening extends upwardly from the lowermost end of the container.

6. The dispenser of claim 1 wherein said opening extends upwardly from the lowermost end of the container, said closure being hingedly connected to said bottom wall for swinging about a horizontal axis at the lowermost end of the container.

7. The dispenser of claim 1 wherein said opening extends upwardly from the lowermost end of the container, said closure being hingedly connected to said bottom wall for swinging about a horizontal axis at the lowermost end of the container, said guide means comprising a wall member having fold lines permitting the wall member to be disposed in a flat arrangement and folded to a three-dimensional inclined ramp configuration suitable to guide said articles outwardly through said opening and having its lower end substantially at said horizontal axis.

8. The dispenser of claim 1 wherein said opening extends upwardly from the lowermost end of the container, said closure being hingedly connected to said bottom wall for swinging about a horizontal axis at the lowermost end of the container, said guide means comprising a wall member having fold lines permitting the wall member to be disposed in a flat arrangement and folded to a three-dimensional inclined ramp configuration suitable to guide said articles outwardly through said opening, and said ramp overlying substantially the entire bottom wall.

9. The dispenser of claim 1 wherein said sidewall, closure, and flange comprise a one-piece element and said guide means comprises a one-piece element.

10. The dispenser of claim 1 wherein said guide means includes sidewall portions biased against the tubular sidewall.

* * * * *